US005482394A

United States Patent [19]

Shinchi et al.

[11] Patent Number: 5,482,394

[45] Date of Patent: Jan. 9, 1996

[54] CONNECTOR EQUIPPED WITH FITTING LEVER AND METHOD OF MOUNTING WINDING SPRING IN IT

[75] Inventors: Akira Shinchi; Toshifumi Matsuura, both of Shizuoka, Japan

[73] Assignee: Yazaki Corporation, Tokyo, Japan

[21] Appl. No.: 209,905

[22] Filed: Mar. 14, 1994

[30] Foreign Application Priority Data

Mar. 17, 1993 [JP] Japan ..... 5-057156

[51] Int. Cl.[6] ..... H01R 13/62

[52] U.S. Cl. ..... 403/325; 29/876; 403/111; 403/146; 403/166; 403/321; 403/327; 439/153; 439/157; 439/372

[58] Field of Search ..... 439/153, 157, 439/160, 310, 372; 403/111, 145, 146, 166, 321, 322, 325, 327, 329; 267/155; 29/436, 622, 876

[56] References Cited

U.S. PATENT DOCUMENTS

| | | | |
|---|---|---|---|
| 4,782,583 | 11/1988 | Castonguay et al. | 29/622 |
| 4,884,046 | 11/1989 | Spinner | 439/157 X |
| 5,135,408 | 8/1992 | Suzuki | 439/372 X |
| 5,230,635 | 7/1993 | Takenouchi et al. | 439/157 |
| 5,320,556 | 6/1994 | Otaka et al. | 439/372 |
| 5,330,362 | 7/1994 | Ito et al. | 439/157 |
| 5,344,194 | 9/1994 | Hatagishi et al. | 439/310 X |

FOREIGN PATENT DOCUMENTS

| | | | |
|---|---|---|---|
| 4-87169 | 3/1992 | Japan . | |
| 5109354 | 4/1993 | Japan | 29/622 |

*Primary Examiner*—Dave W. Arola
*Assistant Examiner*—Andrea Chop
*Attorney, Agent, or Firm*—Armstrong, Westerman, Hattori, McLeland & Naughton

[57] ABSTRACT

A winding spring is preset in a connector, with its winding portion fit at an attaching shaft of the connector, in such a manner that its one end is engaged with the connector and its other end on the side of the fitting lever is engaged with a provisional locking protrusion provided on the connector. The fitting lever is rotated around a supporting shaft of the connector so that a sharp tip of a locking releasing body provided on the fitting lever releases the other end of the winding spring from the provisional protrusion, and the other end of the winding spring, because of its resilient returning operation, is engaged with a locking portion provided at the exterior of the locking releasing body. Thus, the winding spring can be mounted in the connector so that its lever side engagement end is surely engaged with the fitting lever.

2 Claims, 4 Drawing Sheets

CONNECTOR EQUIPPED WITH FITTING LEVER AND METHOD OF MOUNTING WINDING SPRING IN IT

BACKGROUND OF THE INVENTION

1. Field of the Invention

The present invention relates to a connector equipped with a lever for fitting another connector (hereinafter referred to as a fitting lever), which is used for connection of a wire harness for vehicles, and a method of mounting a winding spring for setting the initial position of the fitting operation lever.

2. Description of the Prior Art

Previouly known examples of a connector equipped with a fitting lever and the method of mounting the fitting lever are disclosed in e.g. JP-A (Laid Open) No. 4-87169 and JP-A (Laid Open) No. 5-3059 (U.S. Pat. No. 5,230,635). But, the prior art fitting-lever equipped connector has a disadvantage that the fitting lever is mounted in a connector with poor operability.

SUMMARY OF THE INVENTION

An object of the present invention is to provide a new connector equipped with a fitting lever for another connector.

Another object of the present invention is to provide a method for precisely setting the initial position of a fitting lever in a connector with good operability.

Still another object of the present invention is to provide a method for easily and surely mounting a winding spring used for the above setting at a predetermined position of the above lever when the fitting lever is mounted in the connector.

In accordance with the present invention, there is provided a connector comprising a fitting lever attached so as to rotate around the supporting shaft of the connector; a winding spring for setting the initial position of said fitting lever, said winding spring having a winding portion fit in an attaching shaft of the connector, one end engaged with the connector and other end engaged with the fitting lever; and a provisional locking protrusion for locking the other end of the winding spring to the connector, wherein said fitting lever has a body having a sharp terminal for releasing the engagement of the other end of the winding spring with said locking protrusion.

Further, in accordance with the present invention, there is provided a method of mounting a winding spring in a connector equipped with a fitting lever, comprising the steps of presetting a winding spring with its winding portion fit at an attaching shaft of the connector in such a manner that its one end is engaged with the connector and its other end on the side of the fitting lever is engaged with a provisional locking protrusion provided on the connector, and rotating the fitting lever around the supporting shaft of the connector so that the sharp tip of a locking releasing body provided on the fitting lever releases the other end of the winding spring from the provisional protrusion and the other end of the winding spring, because of its resilient returning operation, is engaged with a locking portion provided at the exterior of the locking releasing body.

In operation, the sharp tip of the engagement releasing operation body advances between the engagement end of the winding spring on the side of the fitting lever and the female connector so that the engagement end drives to release its locking from the provisional locking protrusion.

The above and other objects and features of the present invention will be more apparent from the following description taken in conjunction with the accompanying drawings.

DESCRIPTION OF THE PREFERRED EMBODIMENTS

Figure 1:
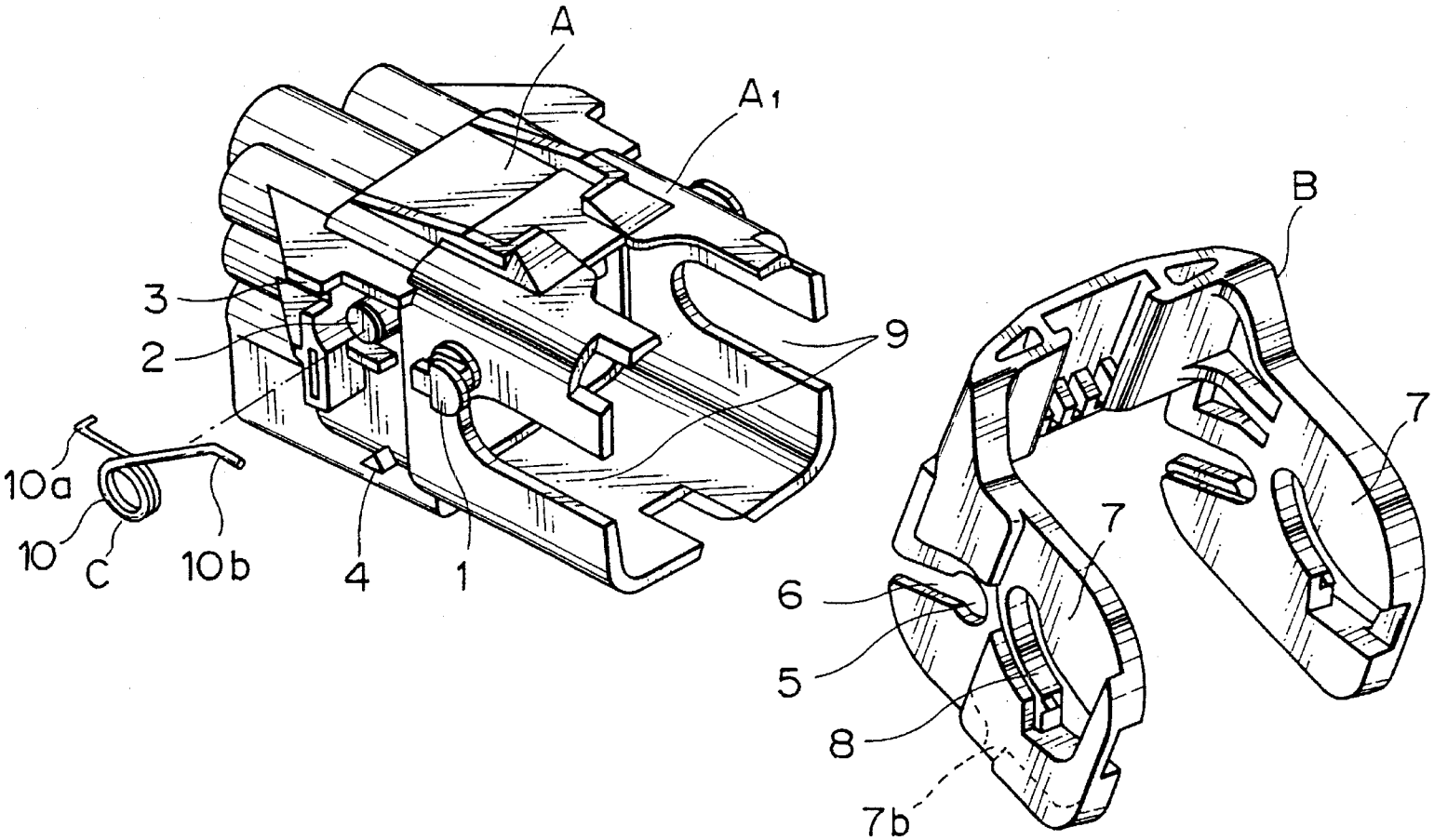
FIG. 1 is an exploded perspective view of a connector equipped with a fitting lever according to the present invention.

In FIG. 1, symbol A denotes a female connector and symbol B denotes a fitting lever. These components are integrally formed of synthetic resin, respectively.

Figure 6:
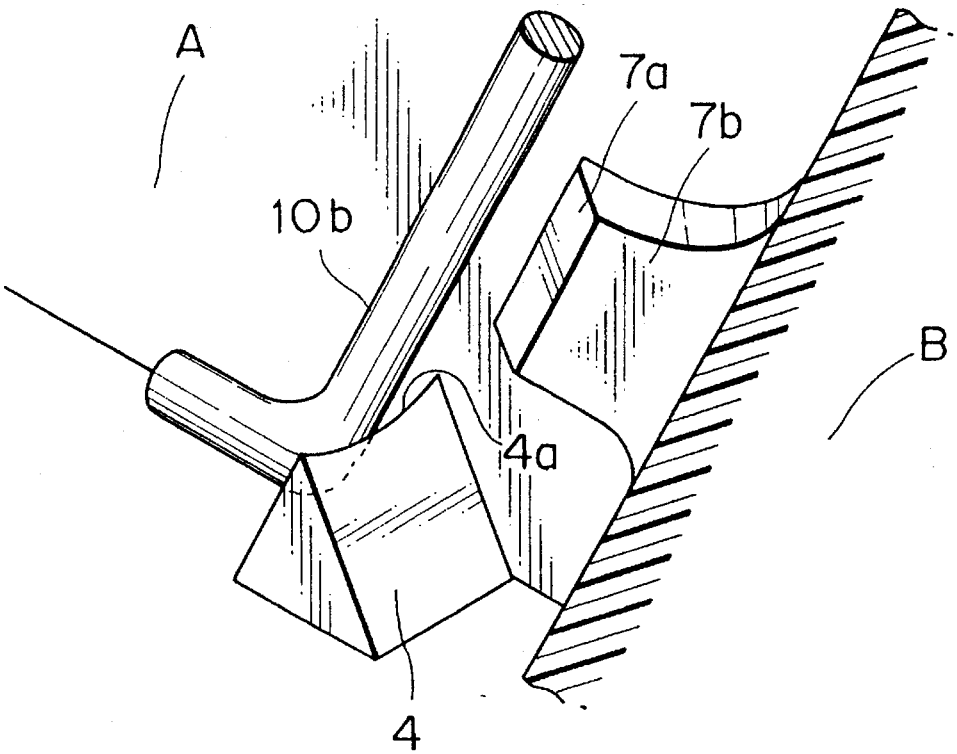
FIG. 6 is a perspective view of the main portion of the state where the lever side engagement end is preset.
Figure 7:
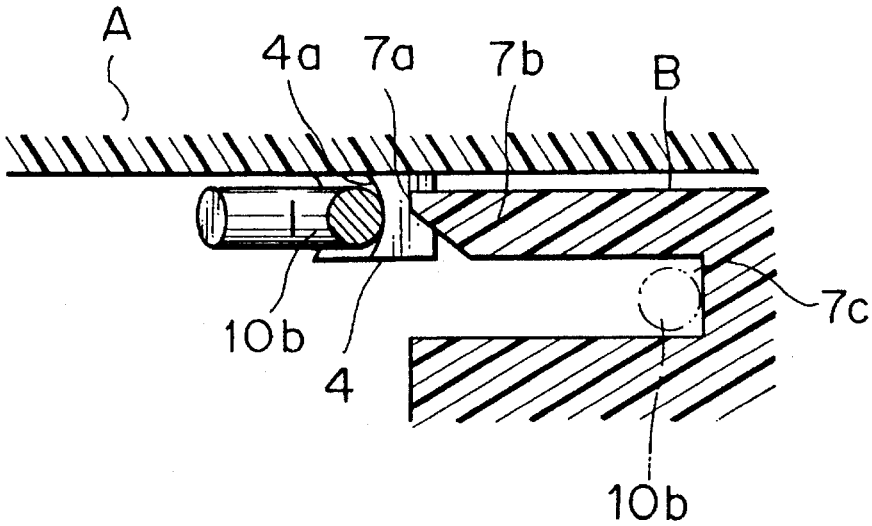
FIG. 7 is a sectional view along line A—A in FIG. 4.

The female connector A includes a supporting shaft 1 for rotating the fitting lever B so as to protrude from both sides of the female connector A, another shaft 2 for attaching a winding spring C behind the supporting shaft 1, which is provided to protrude like the supporting shaft 1, a locking portion 3 for the connector side engagement end of the winding spring further behind the shaft 2, and a provisional locking protrusion 4 having a concave portion **4*a* for the lever side engagement end of the winding spring, which is provided beneath the shaft 2 (see FIGS. 6 and 7**).

On the other hand, the fitting lever B includes a supporting-shaft introducing/guiding recess 6 successive to a bearing hole 5 of the lever B and an operation plate 7 composed of a spring engagement releasing operation body **7*b* having a sharp end 7*a* and a locking portion 7*c* for the lever side engagement end of the winding spring which is formed outside the operation body 7*b* (see FIGS. 6 and 7**).

The operation plate 7 of the fitting lever B includes a driving cam groove 8. The cover A1 of the female connector A includes a guiding recess 9 for the pin-to-be-driven of a male connector which extends from its front end to rear.

The winding spring C is composed of a winding portion 10 and a connector side engagement end **10*a* and a lever side engagement end 10*b* on both sides of the winding portion 10**.

Figure 2:
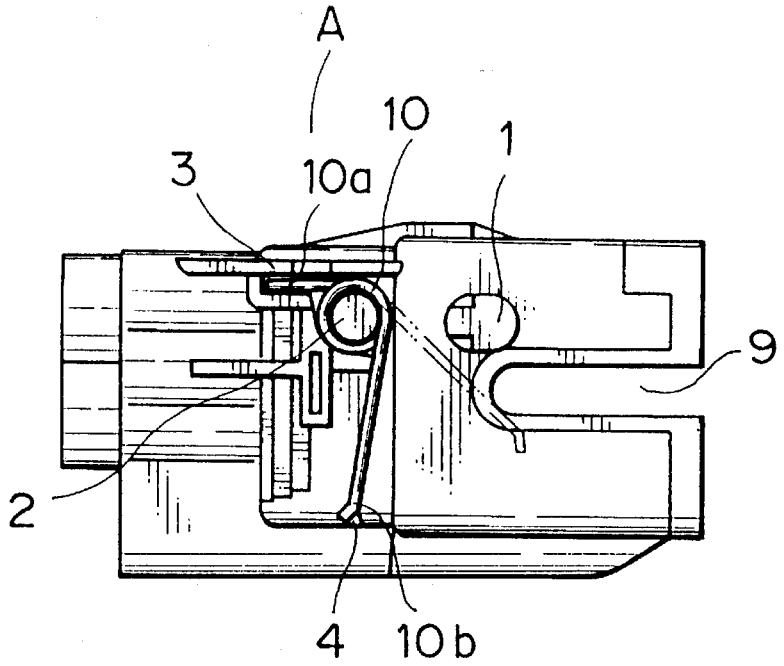
FIG. 2 is a side view of the state where a winding spring is preset in the connector according to the present invention.

The winding spring C is preset with the winding portion 10 fit in the attaching shaft 2 of the female connector A in such a manner that the connector side engagement end **10*a* is engaged with the locking portion 3 and the lever side engagement end 10*b* is engaged with the concave portion 4*a* of the provisional engagement protrusion 4 (FIGS. 2 and 6**).

Figure 3:
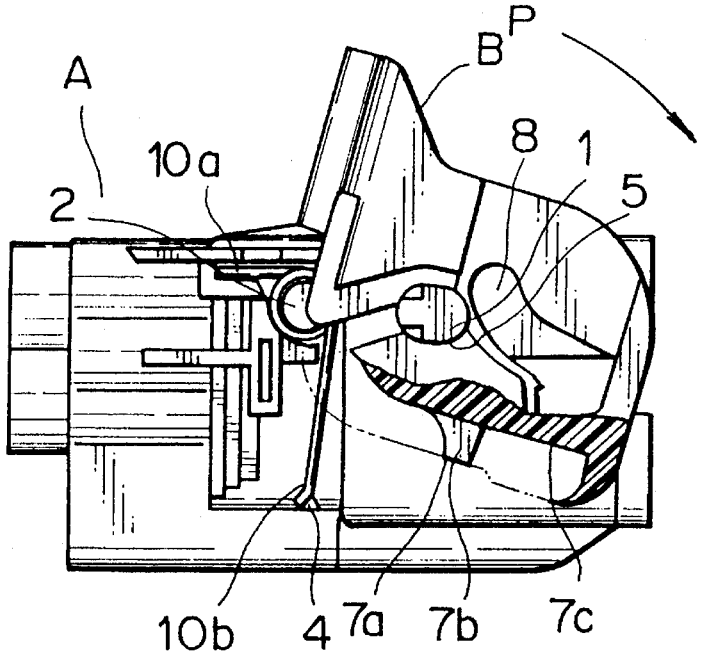
FIG. 3 is a side view of the state where a fitting levers connected to the connector according to the present invention.

In this state, with the supporting-shaft introducing/guiding recess 6 engaged with the supporting shaft 1, the fitting lever B is intruded into the female connector A so that the supporting shaft 1 is engaged with the bearing hole 6. Thus, the fitting operation lever B is attached to the female connector housing A so that it can rotate around the supporting shaft 1 (FIG. 3).

Figure 4:
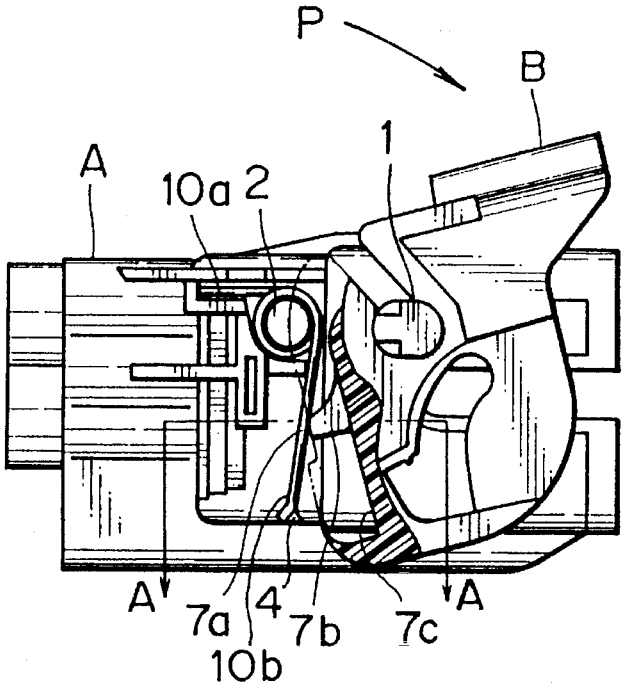
FIG. 4 is a partially broken side view of the state where the fitting lever is so rotated that a locking releasing body is abutted on the lever side engagement end of the winding spring in the connector according to the present invention.
Figure 5:
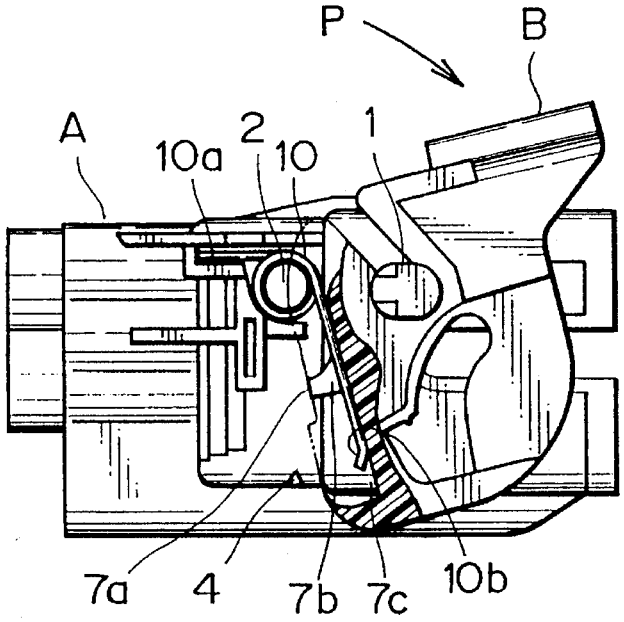
FIG. 5 is a partially broken side view of the state where the lever side engagement end of the winding spring is engaged with the fitting lever in the connector according to the print invention.

When the fitting lever B is rotated towards an arrow P, the spring engagement releasing operation body 7*b* intrudes into between the lever side engagement end 10*b* of the winding spring C and the female connector housing A through the sharp end 7*a* (FIG. 4). Then, since the lever side engagement end 10*b* is swung outwardly, it is released from the provisional engagement protrusion 4 and elastically returned in the direction contrary to the arrow direction which is the lever rotating direction. Thus, the lever side engagement end 10*b* is engaged with the locking portion 7*c* (FIGS. 5 and 7).

The invention claimed is:

1. A connector comprising:

a fitting lever, a supporting shaft, an attaching shaft, and a provisional locking protrusion, said fitting lever attached so as to be rotatable around said supporting shaft of the connector;

a winding spring for setting an initial position of said fitting lever, said winding spring having a first position with a winding portion fit on said attaching shaft of the connector, one end engaged with the connector and the other end engaged with the fitting lever; and said provisional locking protrusion locking the other end of the winding spring to the connector in a second position of the winding spring, wherein said fitting lever has a body having a sharp terminal for releasing the engagement of the other end of the winding spring with said locking protrusion whereby the winding spring is moveable from the second position to the first position.

2. A method of mounting a winding spring in a connector equipped with a fitting lever, an attaching shaft, a provisional locking protrusion, and a supporting shaft, comprising the steps of:

presetting a winding spring with its winding portion fit on said attaching shaft of the connector in such a manner that the winding spring, in a first position, has one end of said spring engaged with the connector and the other end of said spring, on the side of the fitting lever, is engaged with said provisional locking protrusion on the connector; and rotating the fitting lever around said supporting shaft of the connector whereby a sharp tip of a locking releasing body provided on the fitting lever releases the other end of the winding spring from the provisional protrusion, and the other end of the winding spring, because of its resilient returning operation, is engaged with a locking portion provided at the exterior of the locking releasing body.

* * * * *